US005397403A

United States Patent [19]

Horimura et al.

[11] Patent Number: 5,397,403

[45] Date of Patent: Mar. 14, 1995

[54] HIGH STRENGTH AMORPHOUS ALUMINUM-BASED ALLOY MEMBER

[75] Inventors: Hiroyuki Horimura; Tadahiro Kubota; Tuyoshi Baba; Kazuya Takahashi, all of Saitama, all of Japan

[73] Assignee: Honda Giken Kogyo Kabushiki Kaisha, Tokyo, Japan

[21] Appl. No.: 936,064

[22] Filed: Aug. 26, 1992

Related U.S. Application Data

[63] Continuation of Ser. No. 631,629, Dec. 21, 1990, abandoned.

[30] Foreign Application Priority Data

Dec. 29, 1989 [JP] Japan ..... 1-344175

[51] Int. Cl.[6] ..... C22C 45/08

[52] U.S. Cl. ..... 148/403; 420/550

[58] Field of Search ..... 148/403; 420/550

[56] References Cited

U.S. PATENT DOCUMENTS

| | | | |
|---|---|---|---|
| 4,851,193 | 7/1989 | Mahajan et al. | 420/550 |
| 4,950,452 | 8/1990 | Masumoto et al. | 420/550 |
| 4,964,927 | 10/1990 | Shiflet et al. | 148/403 |
| 4,990,198 | 2/1991 | Masumoto et al. | 148/403 |
| 5,053,085 | 10/1991 | Masumoto et al. | 148/403 |

FOREIGN PATENT DOCUMENTS

| | | |
|---|---|---|
| 100850 | 2/1984 | European Pat. Off. . |
| 271095 | 6/1988 | European Pat. Off. . |
| 0317710 | 7/1988 | European Pat. Off. . |
| 339676 | 11/1989 | European Pat. Off. . |

OTHER PUBLICATIONS

Rare Metals Handbook, Clifford A. Hampel, ed., Reinhold Publishing, 1954, pp. 335–336.

Mahojan, Y. R. et al., "Rapidly Solidified Microstructure of Al–sFe–4 lanthonide Alloys", *Journal of Materials Science,* vol. 22, 1987, pp. 202–206.

Eliezer, D. et al., "Mössbauer studies of rapidly solidified Al–rare earth alloys", *Journal of Materials Science* 5, 1986, pp. 781–782.

Jovanovie, D., *Chemical Abstracts,* vol. Ud. 71 1969, p. 232, No. 6117f.

Inoue, A., et al. (I), *New Amorphous Alloys with Good Ductility in Al–Y–M and Al–La–M (M=Fe, Co, Ni or Cu) Systems,* Japanese Journal of Applied Physics, vol. 27, No. 3, Mar. 1988, pp. L–280–L282.

Inoue, A., et al. (II), *Aluminum–Based Amorphous Alloys with Tensile Strength above 980 Mpa* (100 kg/mm$^2$, Japanese Journal of Applied Physics, vol. 27, No. 4, Apr. 1988, pp. L–479–L482.

Inoue, A., et al. (III), *Glass Transition Behavior of Al–Y–Ni and Al–Ce–Ni Amorphous Alloys,* Japanese Journal of Applied Physics, vol. 27, No. 9, Sep. 1988, pp. L–1579–L–1582.

Inoue, A., et al. (IV), *Al–Y–Ni Amorphous Powders Prepared By High–Pressure Gas Atomization,* Materials Science Letters, Dec. 1988, pp. 1287–1290.

J. L. Wagner "Structural Effects on the Superconducting and Magnetic Behavior of Aluminum–Rich Metallic Glasses".

*Primary Examiner*—George Wyszomierski

*Attorney, Agent, or Firm*—Lyon & Lyon

[57] ABSTRACT

A high strength amorphous aluminum-based alloy comprises 75 atom % (inclusive) to 90 atom % (inclusive) of Al; 3 atom % (inclusive) to 15 atom % (inclusive) of Ni; and 3 atom % (inclusive) to 12 atom % (inclusive) of at least one element selected from the group consisting of Dy, Er and Gd, and has an amorphous phase volume fraction (Vf) of at least 50%. This leads to a higher amorphous phase forming ability and a wider plastically workable temperature region so that the workability of the alloy is satisfactory to produce structural members utilizing a working process such as a hot extruding process, a hot forging process or the like.

14 Claims, 10 Drawing Sheets

HIGH STRENGTH AMORPHOUS ALUMINUM-BASED ALLOY MEMBER

This is a continuation of application Ser. No. 07/631,629, filed on Dec. 21, 1990, now abandoned.

BACKGROUND OF THE INVENTION

1. Field of the Invention

The field of the present invention is high strength amorphous aluminum-based alloys and processes for producing an amorphous aluminum-based alloy structural member using the same.

2. Description of the Prior Art

There are numerous known amorphous-aluminum-based alloys comprising various transition elements added to Al.

However, the conventional amorphous aluminum-based alloys suffer from a problem that the amorphous phase forming ability in production thereof is relatively lower. Another problem associated with such conventional alloys is that in producing a member using such alloys, the workability thereof is inferior, because a plastically workable temperature region between the glass transition temperature (Tg) and the crystallization temperature (Tx) is relatively narrow.

There is also a conventionally known process for producing a structural member of an amorphous aluminum-based alloy, which comprises forming a green compact from an amorphous aluminum-based alloy powder having an amorphous phase volume fraction (Vf) of 50% or more and subjecting the green compact to a hot plastic working. In this producing process, the density of the green compact is set relatively low.

When the density of the green compact is relatively low, however, the following problem is encountered: In a hot plastic working, e.g., in a hot extrusion, a relatively large slip may occur between the alloy powder particles forming the green compact, thereby causing the temperature of the alloy powder to be increase due to the attendant friction and deformation, with the result that the crystallization advances to provide a reduction in volume fraction the amorphous phase in the resulting structural member.

SUMMARY OF THE INVENTION

It is an object of the present invention to provide an alloy of the type described above, which has a greater amorphous phase-forming ability and a wider plastically workable temperature region.

To achieve the above object, there is provided a high strength amorphous aluminum-based alloy comprising 75 atom % (inclusive) to 90 atom % (inclusive) of Al; 3 atom % (inclusive) to 15 atom % (inclusive) of Ni; 3 atom % (inclusive) to 12 atom % (inclusive) of at least one element selected from the group consisting of Dy, Er and Gd, and having an amorphous phase volume fraction (Vf) of at least 50%.

In addition, according to the present invention, there is provided a high strength amorphous aluminum-based alloy comprising 3 atom % (inclusive) to 15 atom % (inclusive) of Ni; 1 atom % (inclusive) to 12 atom % (inclusive) of at least one element selected from the group consisting of Dy, Er and Gd; and 8 atom % or less of at least one rare earth element selected from the group consisting of La, Ce, Pr, Nd and Mm (misch metal).

Further, according to the present invention, there is provided a high strength amorphous aluminum-based alloy comprising Ni and at least one element selected from the group consisting of Co and Fe in a total amount of 3 atom % (inclusive) to 15 atom % (inclusive) in place of Ni added alone.

If the contents of Al, Ni and at least one element selected from the group consisting of Dy, Er and Gd are specified as described above, the amorphous phase forming ability can be enhanced. Therefore, it is possible to produce a high strength amorphous aluminum-based alloy having an amorphous phase volume fraction (Vf) of 50% or more by utilizing an industrial producing process such as a gas atomizing process and the like. Such an alloy has the advantage of a wider plastically workable temperature region because it has a larger endotherm (J/g) between the glass transition temperature (Tg) and the crystallization temperature (Tx).

However, if the content of each of the chemical constituents departs from the above-described range, the alloy of the type described above cannot be produced by an industrial producing process, and the resulting alloy has a reduced toughness.

If rare earth elements such as La, Ce, Pr, Nd and Mm are added as described above, the amorphous phase forming ability of the above-described alloy can be further enhanced.

However, if the content of the rare earth element depart from the above-described range, it is impossible to provide an effect as described above.

If Co is added along with Ni as described above, the amorphous phase forming ability of the above-described alloy can be enhanced, and it is also possible to provide a raised crystallization temperature (Tx) to increase the endotherm and to widen the plastically workable temperature region.

Even if Fe is added, it is believed to provide a raised crystallization temperature (Tx) of the resulting alloy to improve the heat resistance thereof, but the Fe content is set in the range of 0.5 atom % (inclusive) to 3 atom % (inclusive). If the Fe content is less than 0.5 atom %, an effect as described above is not obtained. Any Fe content exceeding 3 atom % will result in a reduced amorphous phase forming ability. It is desirable to add Fe along with Co.

It is another object of the present invention to provide a process for producing a high strength structural member of a high strength amorphous aluminum-based alloy.

To achieve the above object, according to the present invention, there is provided a process for producing a structural member of an amorphous aluminum-based alloy, comprising the steps of forming a green compact from an amorphous aluminum-based alloy having an amorphous phase volume fraction (Vf) of 50% or more and subjecting the green compact to a hot plastic working, wherein the formation of the green compact is conducted at a temperature in a range lower than the crystallization temperature (Tx) of the amorphous phase by at least 40° C., thereby setting the density of the green compact to at least 80%.

In forming a high density green compact having a density of 80% or more, it is desirable in consideration of the plasticity of the alloy powder that such formation is conducted in a higher temperature region.

In such a case, if the densification of the green compact is effected by pressing at a temperature in the vicinity of the crystallization temperature of the amorphous phase, the temperature of the alloy powder may be increased, due to the friction occurring between particles of the alloy powder beyond the crystallization temperature (Tx).

In the present invention, however, it is possible to inhibit the crystallization attendant upon the densification of the green compact by setting the temperature region during formation of the green compact in a range lower than crystallization temperature (Tx) by at least 40° C.

In addition, it is possible to lessen the degree of slip between the particles of the alloy powder by subjecting the high density green compact to a hot plastic working. This ensures that a structural member having a higher volume fraction of the amorphous phase can be produced.

The above and other objects, features and advantages of the invention will become apparent from a reading of the following description of the preferred embodiments, in conjunction with the accompanying drawings.

DESCRIPTION OF THE PREFERRED EMBODIMENTS

Various amorphous aluminum-based alloys which will be described hereinbelow were produced by utilizing a He gas atomizing process. More specifically, the interior of a chamber was depressurized to $2\times10^{-3}$ Torr or less, and an Ar gas was introduced into the chamber. Then, 4 Kg of an alloy was heated to a molten condition by high-frequency heating and then atomized under a He gas pressure of 100 kg f/cm$^2$, thereby providing an alloy powder.

I. A first group of amorphous aluminum-based alloys

An amorphous aluminum-based alloy belonging to this first group has a composition comprising 75 atom %≦Al≦90 atom %, 3 atom %≦Ni≦15 atom %, and 3 atom %≦heavy rare earth element≦12 atom %.

Here, at least one element selected from the group consisting of Dy, Er and Gd corresponds to the heavy rare earth element.

The amorphous aluminum-based alloys produced using Dy as the heavy rare earth element include those having a composition comprising 80 atom %≦Al≦90 atom %, 3 atom %≦Ni≦13 atom %, and 3 atom %≦Dy≦12 atom %.

Table I illustrates the composition, structure, endotherm and crystallization temperature (Tx) of the amorphous aluminum-based alloys (1) to (9) belonging to the first group and another alloy (10) as a comparative example. In the "structure" column, a indicates that the alloy is of amorphous structure, and c indicates that the alloy is of a crystalline structure.

TABLE I

| Alloy No. | Composition (atom %) | Structure | Endotherm (J/g) | Tx (°C.) |
|---|---|---|---|---|
| (1) | $Al_{85}Ni_7Dy_8$ | a | 7 | 279.8 |
| (2) | $Al_{85}Ni_8Dy_7$ | a | 7 | 271.1 |
| (3) | $Al_{84}Ni_8Dy_8$ | a | 7 | 285.9 |
| (4) | $Al_{84}Ni_9Dy_7$ | a | 8 | 286.1 |
| (5) | $Al_{83}Ni_9Dy_8$ | a | 7 | 301.0 |
| (6) | $Al_{84}Ni_{10}Dy_6$ | a | 8 | 286.6 |
| (7) | $Al_{83}Ni_{10}Dy_7$ | a | 6 | 299.2 |
| (8) | $Al_{83}Ni_{11}Dy_6$ | a | 7 | 298.4 |
| (9) | $Al_{82}Ni_{12}Dy_6$ | a | 7 | 312.2 |
| (10) | $Al_{92}Ni_4Dy_4$ | c | <1 | 310.1 |

Figure 1:
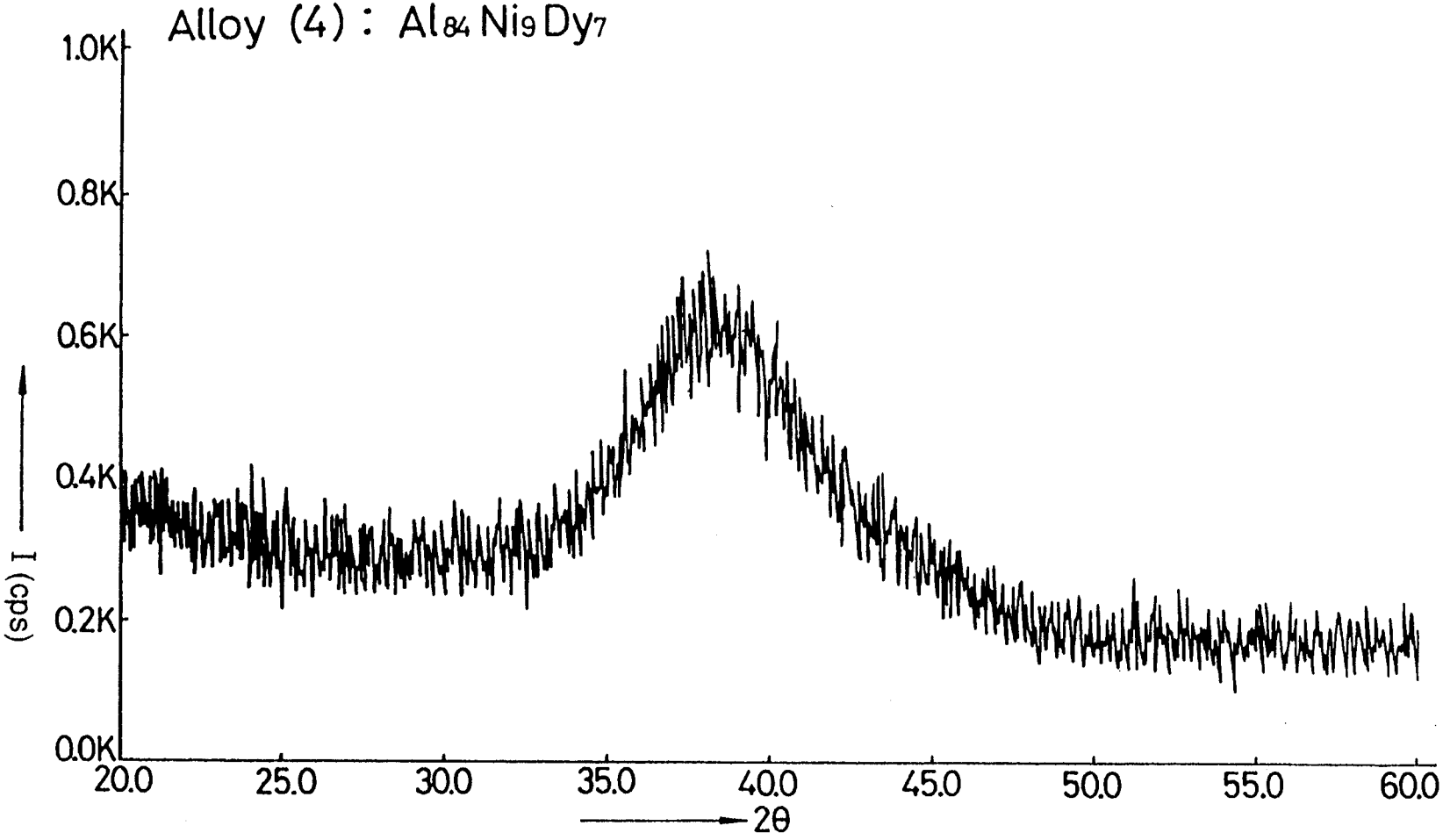
FIG. 1 is an X-ray diffraction pattern diagram for an amorphous aluminum-based alloy.

FIG. 1 is an X-ray diffraction pattern diagram for the amorphous aluminum-based alloy (4), and in FIG. 1, a halo pattern peculiar to the amorphous alloy can be seen.

Figure 2:
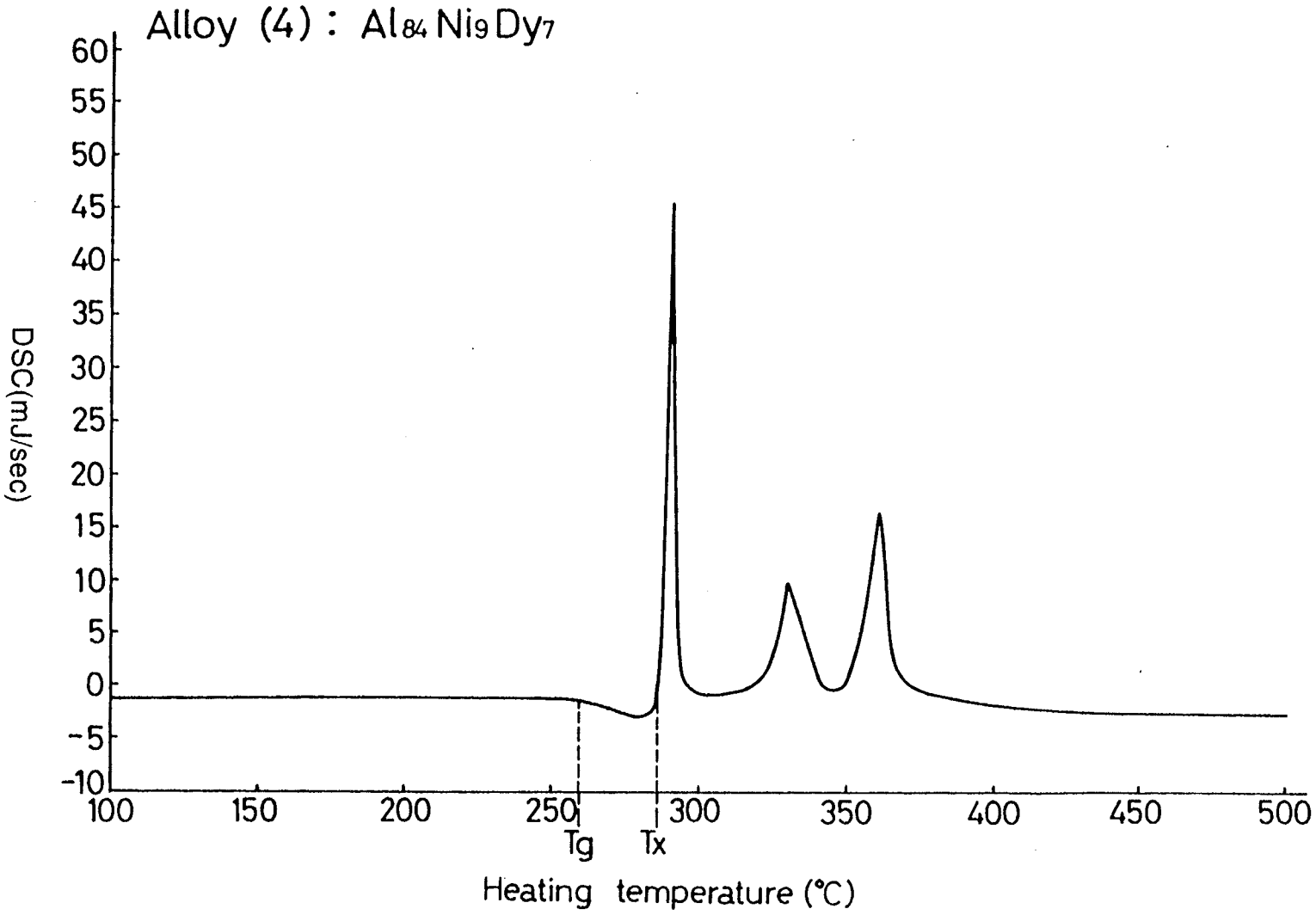
FIGS. 2 to 9 are thermocurve diagrams of a differential thermal analysis for various amorphous aluminum-based alloys.

FIG. 2 is a thermocurve diagram of a differential thermal analysis for the alloy (4), wherein the glass transition temperature (tg) is of 259.5° C., and the crystallization temperature (tx) is of 286.1° C. The endotherm between the plastification temperature (Tg) and the crystallization temperature (Tx) is of 8 J/g.

Figure 3:
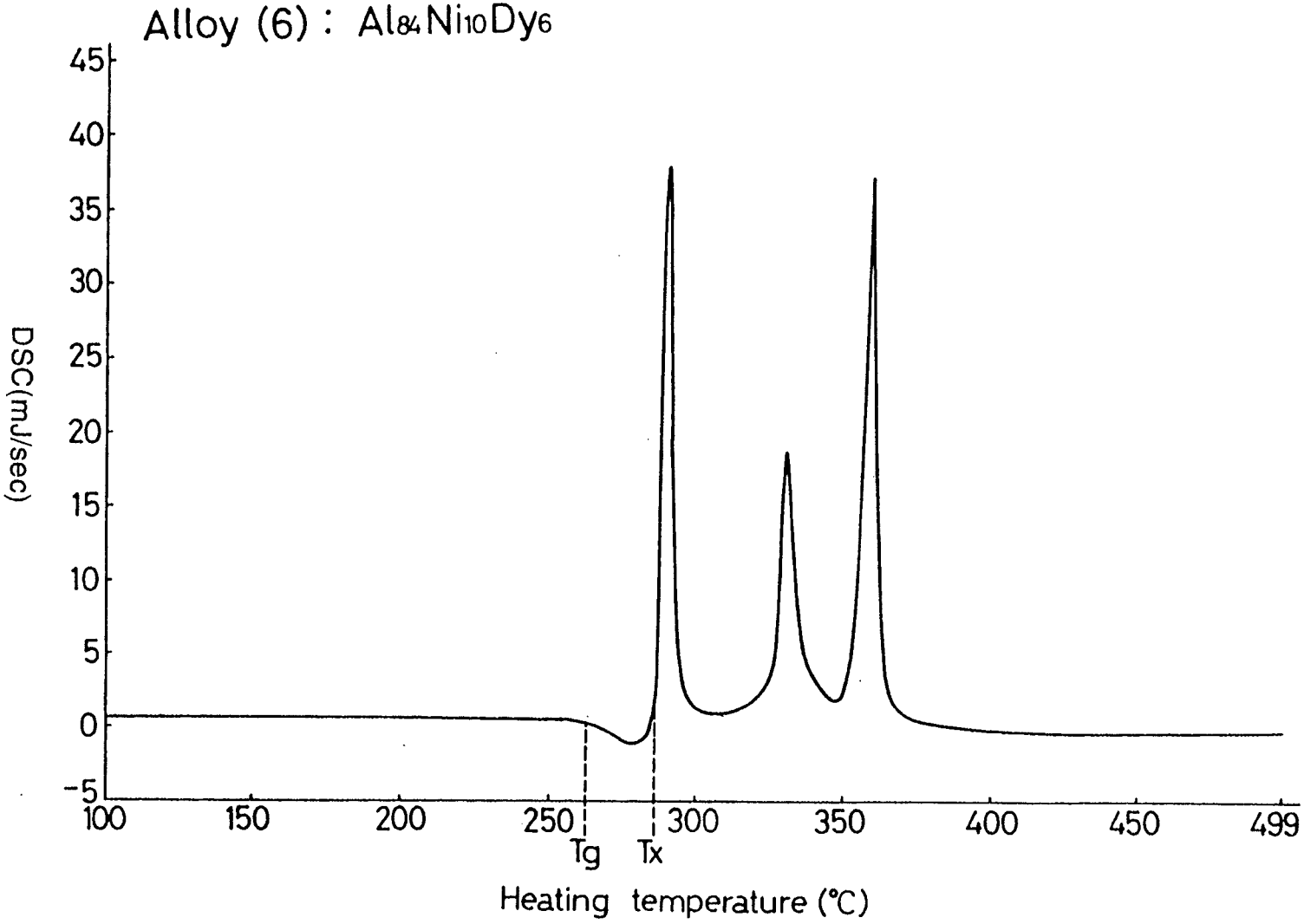

FIG. 3 is a thermocurve diagram of a differential thermal analysis for the alloy (6), wherein the glass transition temperature (Tg) is of 261.7° C., and the crystallization temperature (Tx) is of 286.6° C. The endotherm between the glass transition temperature (Tg) and the crystallization temperature (Tx) is of 8 J/g.

The Al—Ni—Dy type amorphous aluminum-based alloys (1) to (9) are higher in amorphous phase forming ability and have a volume fraction of an amorphous phase of 100%. In addition, they have endotherms as high as 6 j/g or more, and hence, have a wider plastically workable temperature region. This ensures that in producing members using the above-described alloys (1) to (9) by utilizing a working process such as a hot extruding process, a hot forging process or the like, the workability thereof is satisfactory.

II. A second group of amorphous aluminum-based alloys

An amorphous aluminum-based alloy belonging to the second group has a composition comprising 75 atom %≦Al≦90 atom %, 3 atom %≦Ni≦15 atom %, 1 atom %≦heavy rare earth element≦12 atom %, and light rare earth element≦8 atom %.

Here, at least one element selected from the group consisting of Dy, Er and Gd corresponds to the heavy rare earth element. In addition, at least one element selected from the group consisting of La, Ce, Pr, Nd and Mm (misch metal) corresponds to the light rare earth element. The addition of such a light rare earth element further enhances the amorphous phase forming ability for the above described alloys.

The amorphous aluminum-based alloys produced using Dy as a heavy rare earth element include those having a composition comprising 80 atom %≦Al≦90 atom %, 3 atom %≦Ni≦13 atom %, 1 atom %≦Dy≦12 atom %, and light rare earth element≦6 atom %.

The use of the heavy rare earth element and the light rare earth element in combination is an effective technique for enhancing the amorphous phase forming ability. Examples of amounts of incorporation of chemical constituents in this case are as follows:

80 atom %≦Al≦90 atom %, 3 atom %≦Ni≦13 atom %, 1 atom %≦light rare earth element≦10 atom %, and 1 atom %≦light rare earth element≦6 atom %.

Table II illustrates the composition, structure, endotherm and crystallization temperature (Tx) of the amorphous aluminum-based alloys (11) to (23) belonging to the second group and other alloys (24) to (29) as comparative examples. In the "structure" column, a indicates that the alloy is of amorphous structure.

TABLE II

| Alloy No. | Composition (atom %) | Structure | Endotherm (J/g) | Tx (°C.) |
|---|---|---|---|---|
| (11) | $Al_{84}Ni_{10}Dy_3Md_3$ | a | 8 | 284.0 |
| (12) | $Al_{84}Ni_{10}Dy_2Mm_4$ | a | 7 | 284.7 |
| (13) | $Al_{84}Ni_{10}Dy_1Md_5$ | a | 8 | 280.3 |
| (14) | $Al_{84}Ni_{10}Er_3Md_3$ | a | 8 | 286.0 |
| (15) | $Al_{84}Ni_{10}Dy_3La_3$ | a | 8 | 288.3 |
| (16) | $Al_{82}Ni_{10}Dy_4La_4$ | a | 8 | 327.1 |
| (17) | $Al_{81}Ni_{12}Dy_{3.5}La_{3.5}$ | a | 5 | 336.1 |
| (18) | $Al_{84}Ni_{10}Dy_3Ce_3$ | a | 7 | 284.2 |
| (19) | $Al_{82}Ni_{10}Dy_4Ce_4$ | a | 5 | 320.3 |
| (20) | $Al_{81}Ni_{12}Dy_{3.5}Ce_{3.5}$ | a | 5 | 324.8 |
| (21) | $Al_{84}Ni_{10}Dy_3Pr_3$ | a | 9 | 284.4 |
| (22) | $Al_{82}Ni_{10}Dy_4Pr_4$ | a | 5 | 320.6 |
| (23) | $Al_{84}Ni_{10}Dy_3Nd_3$ | a | 8 | 286.7 |
| (24) | $Al_{82}Ni_{10}La_4Pr_4$ | a | 1 | 330.7 |
| (25) | $Al_{82}Ni_{10}La_4Ce_4$ | a | 1 | 331.1 |
| (26) | $Al_{82}Ni_{10}Ce_4Nd_4$ | a | <1 | 340.7 |
| (27) | $Al_{86}Ni_{10}Mm_4$ | a | <1 | 224.7 |
| (28) | $Al_{85}Ni_{10}Md_5$ | a | 3 | 265.7 |
| (29) | $Al_{84}Ni_{10}Md_6$ | a | 4 | 285.6 |

Figure 4:
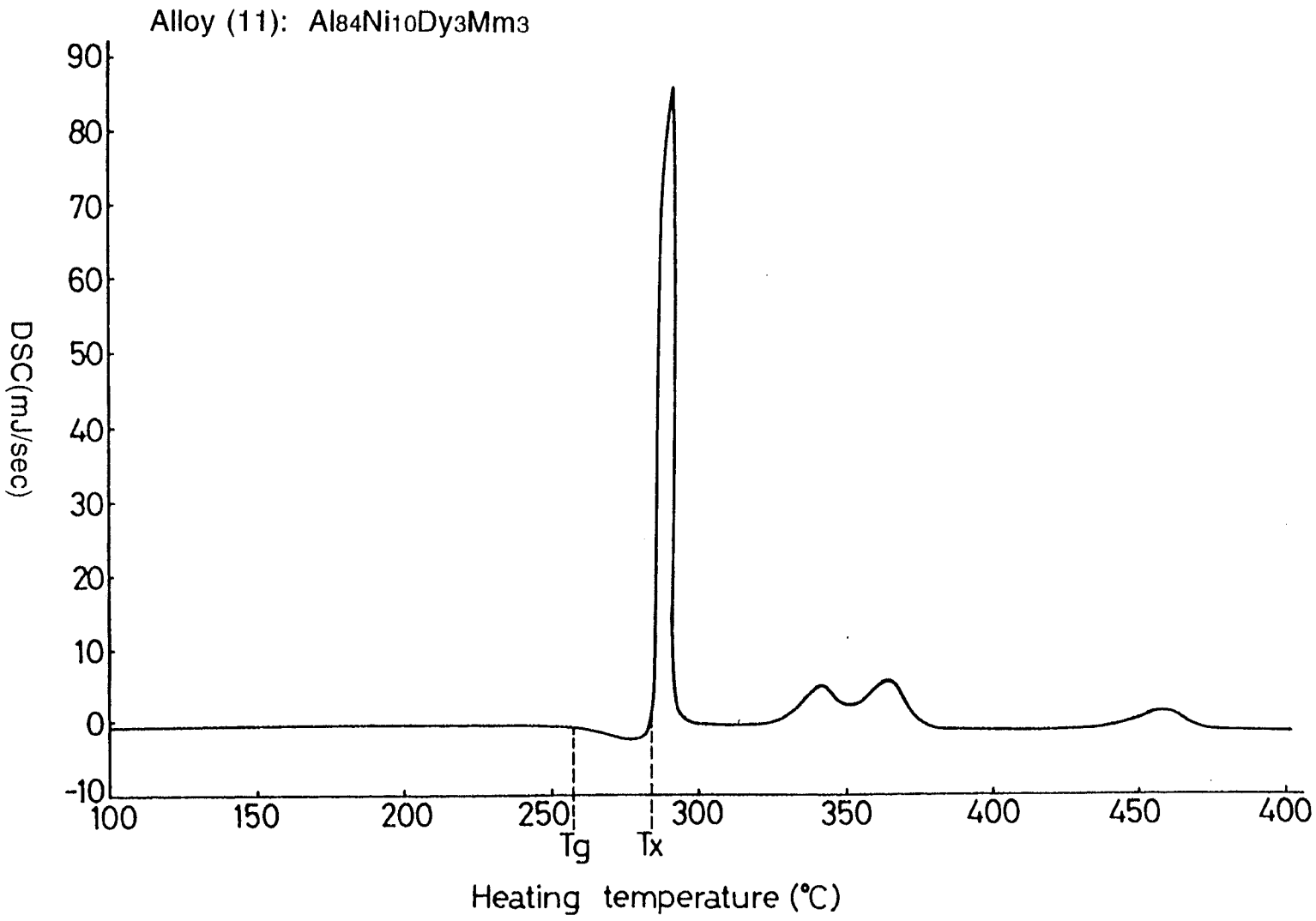

FIG. 4 is a thermocurve diagram of a differential thermal analysis for the alloy (11), wherein the glass transition temperature (Tg) is of 257.1° C., and the crystallization temperature (Tx) is of 284.0° C. The endotherm between the glass transition (Tg) and the crystallization temperature (Tx) is of 8 J/g.

Figure 5:
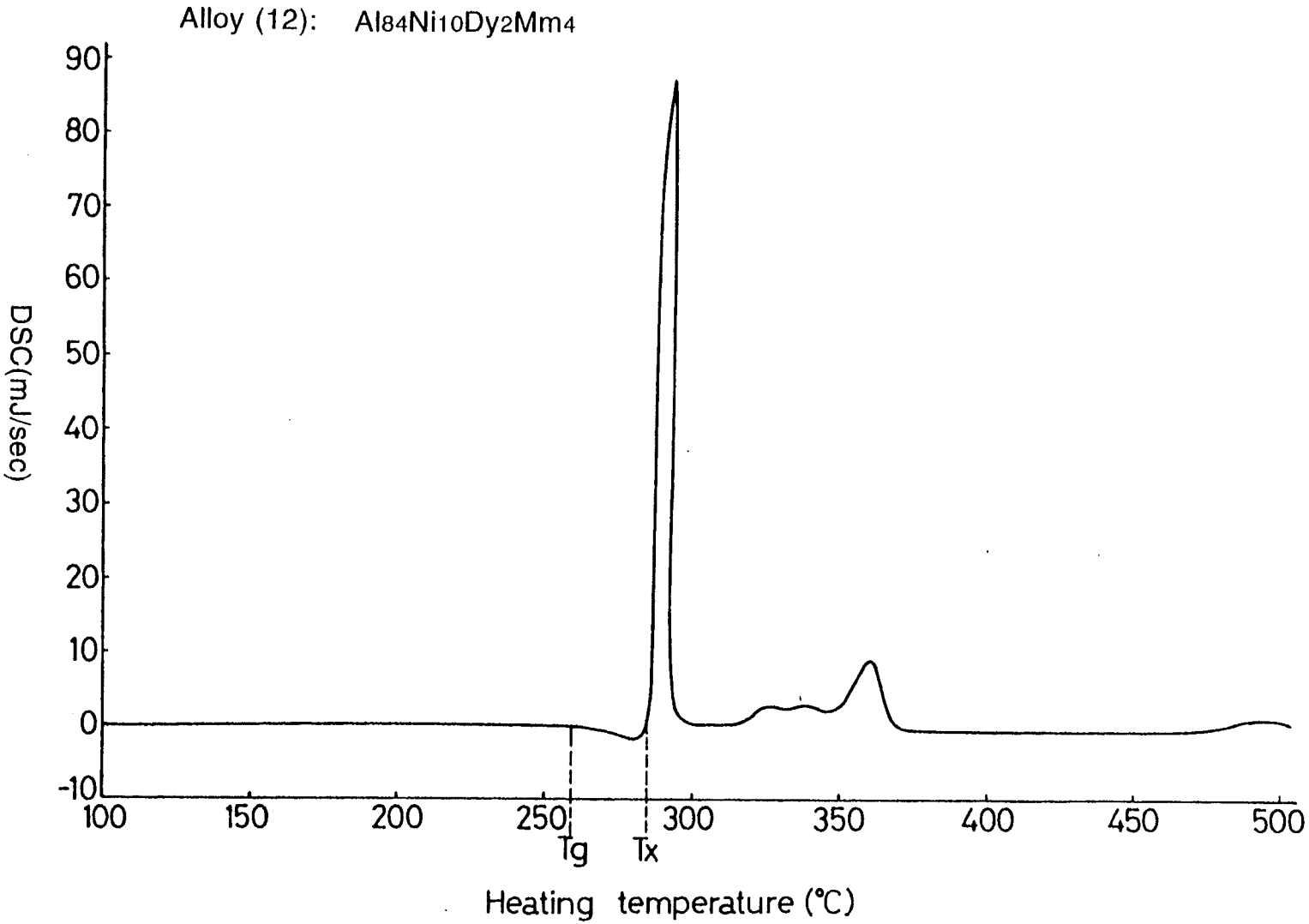

FIG. 5 is a thermocurve diagram of a differential thermal analysis for the alloy (12), wherein the glass transition temperature (Tg) is of 258.9° C., and the crystallization temperature (Tx) is of 284.7° C. The endotherm between the glass transition temperature (Tg) and the crystallization temperature (Tx) is of 7 J/g.

Figure 6:
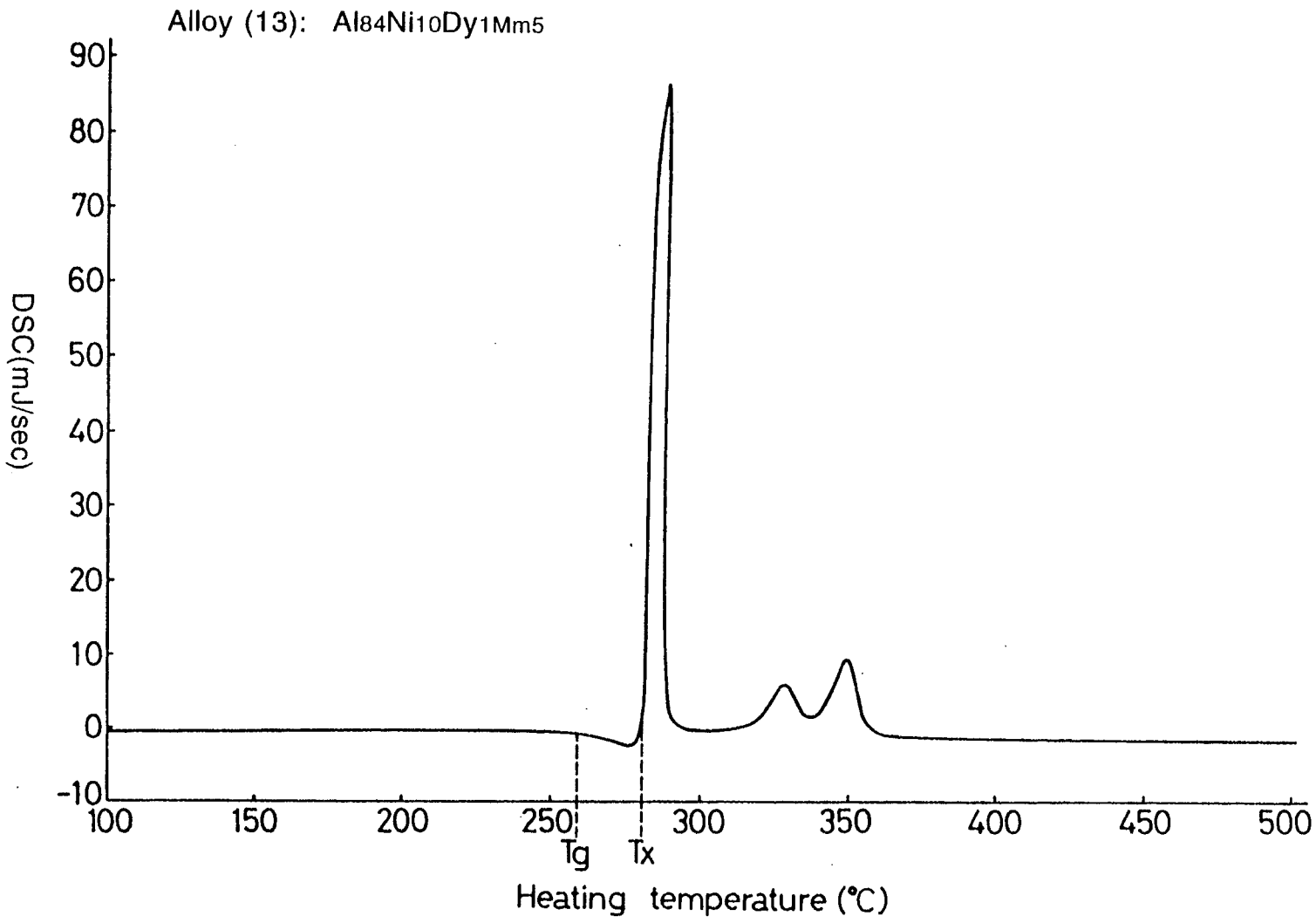

FIG. 6 is a thermocurve diagram of a differential thermal analysis for the alloy (13), wherein the glass transition temperature (Tg) is of 258.3° C., and the crystallization temperature (Tx) is of 280.3° C. The endotherm between the glass transition temperature (Tg) and the crystallization temperature (Tx) is of 8 J/g.

Figure 7:
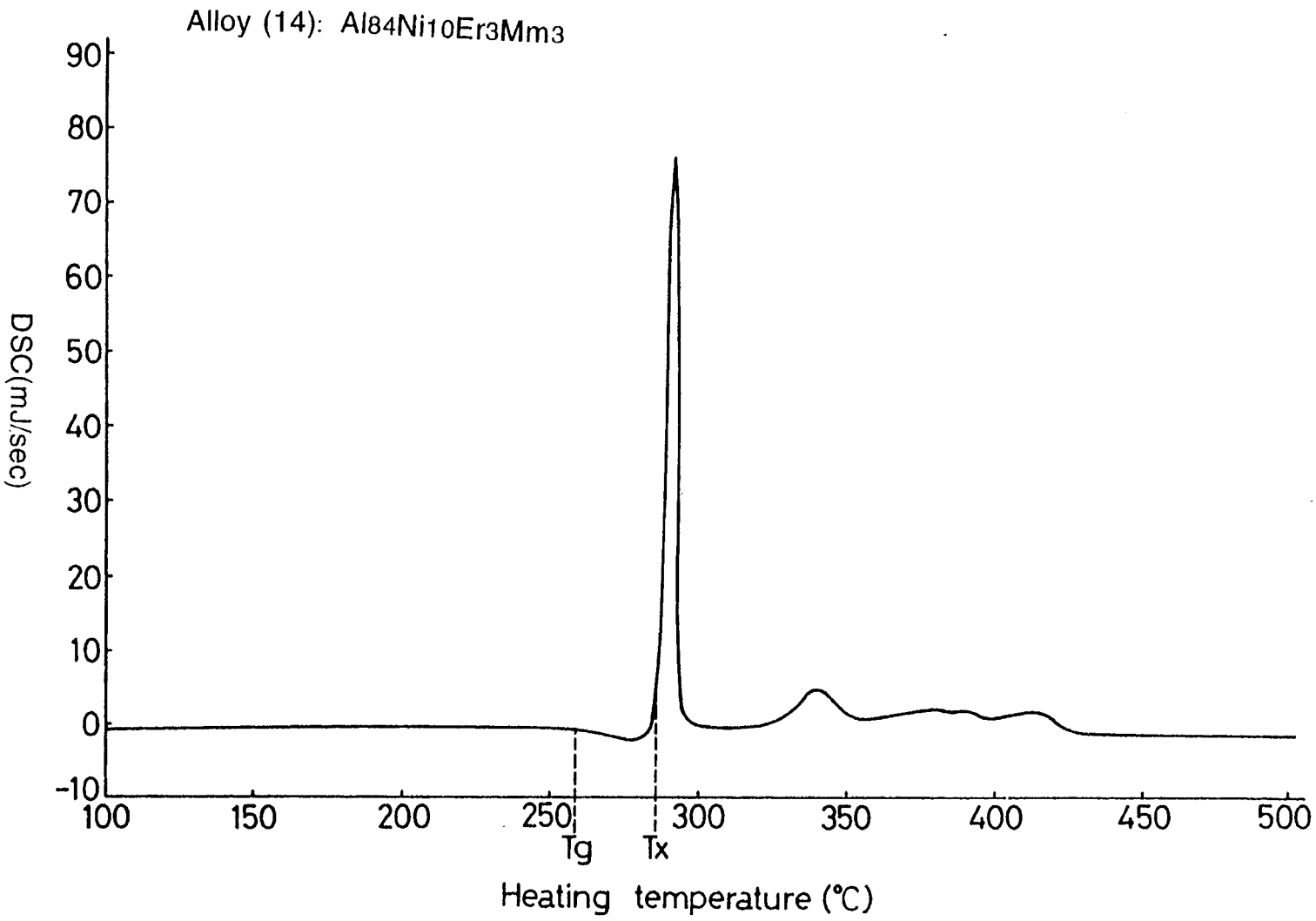

FIG. 7 is a thermocurve diagram of a differential thermal analysis for the alloy (14), wherein the glass transition temperature (Tg) is of 258.9° C., and the crystallization temperature (Tx) is of 286.0° C. The endotherm between the glass transition temperature (Tg) and the crystallization temperature (Tx) is of 8 J/g.

The amorphous aluminum-based alloys (11) to (23) are higher in amorphous phase forming ability and have an amorphous phase volume fraction of 100%. In addition, they also have an endotherm as high as 5 J/g or more and hence, have a wider plastically workable temperature region. This ensures that in producing members using the alloys (11) to (23) by utilizing a working process such as a hot extruding process, a hot forging process and the like, the workability thereof is satisfactory.

If Mm is used as a light rare earth element in each of the alloys (11) to (14), the alloys (11) to (14) can be produced at a lower cost because of a lower price of Mm, leading to an advantage to provide for mass production.

The alloys (24) to (29) as comparative examples are lower in endotherm and thus, have a narrower plastically workable temperature region, resulting in an inferior workability, because light rare earth elements such as Le, Ce, Pr, Nd and Mm (La+Ce) are used in combination, and a heavy rare earth element such as Dy, Er, or Gd is not present.

III. A third group of amorphous aluminum-based alloys

An amorphous aluminum-based alloy belonging to the third group has a composition comprising 75 atom %≦Al≦90 atom %, 3 atom %≦Ni+Co and/or Fe≦15 atom %, and 3 atom %≦heavy rare earth element≦12 atom %.

Here, at least one element selected from the group consisting of Dy, Er and Gd corresponds to the heavy rare earth element.

The amorphous aluminum-based alloys produced using Ni and Co in combination and using Dy as a heavy rare earth element include those having a composition comprising 80 atom %≦Al≦90 atom %, 3 atom %≦Ni+Co≦13 atom %, and 3 atom %≦Dy≦12 atom %.

The amorphous aluminum-based alloys produced using Ni, Co and Fe in combination and using Dy as a heavy rare earth element include those having a composition comprising 80 atom %≦Al≦90 atom %, 3 atom %≦Ni+Co≦13 atom %, 0.5 atom %≦Fe≦3 atom %, and 3 atom %≦Dy≦12 atom %.

Table III illustrates the composition, structure, endotherm and crystallization temperature (Tx) of amorphous aluminum-based alloys (30) to (33) belonging to the third group. In the "structure" column, a indicates that the alloy is of amorphous structure.

TABLE III

| Alloy No. | Composition (atom %) | Structure | Endotherm (J/g) | Tx (°C.) |
|---|---|---|---|---|
| (30) | $Al_{84}Ni_8Gd_6Co_2$ | a | 6 | 286.6 |
| (31) | $Al_{85}Ni_5Dy_8Co_2$ | a | 8 | 296.8 |
| (32) | $Al_{84}Ni_8Dy_6Co_2$ | a | 5 | 294.3 |
| (33) | $Al_{85}Ni_4Dy_8Co_2Fe_1$ | a | 5 | 324.3 |

Figure 8:
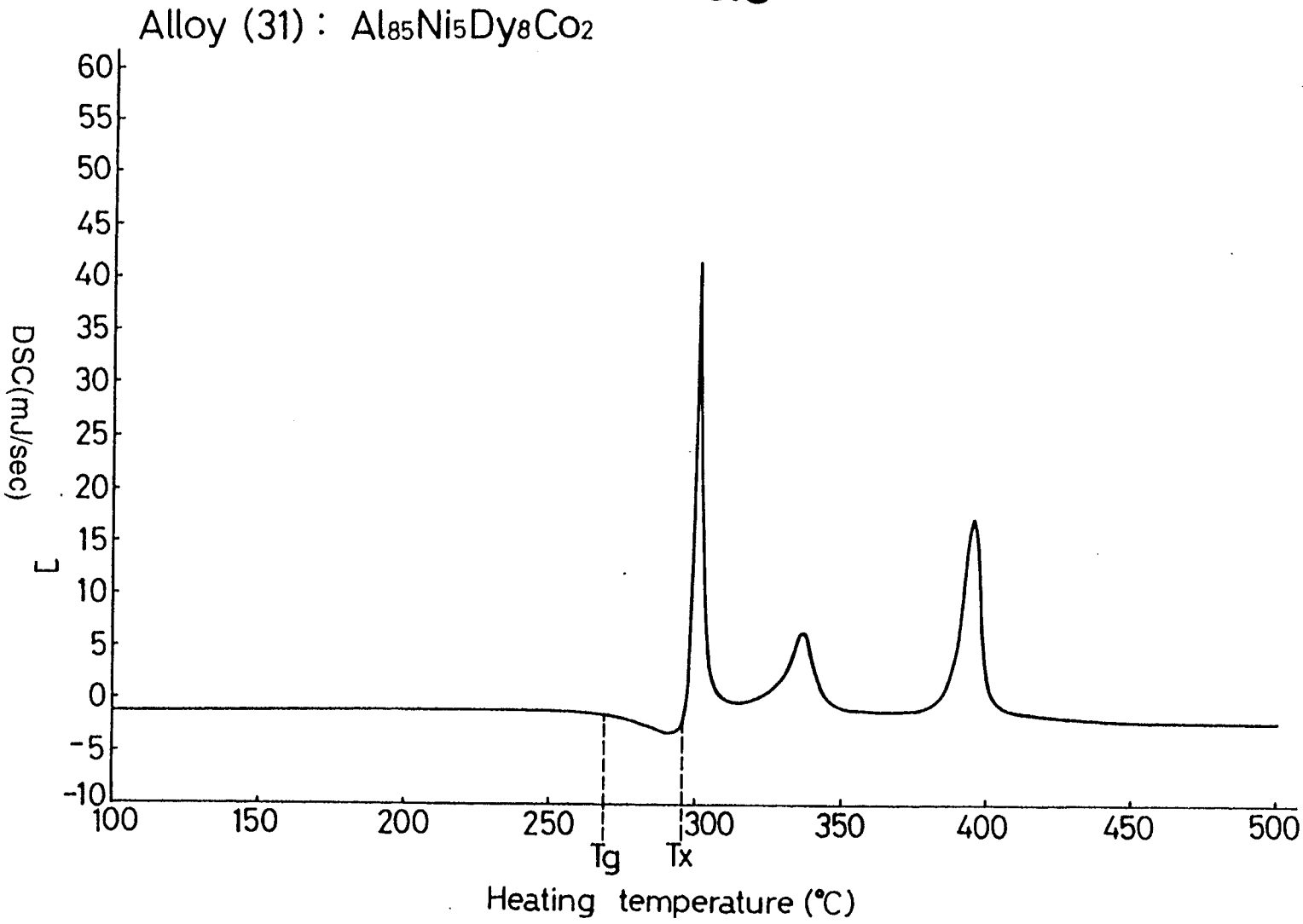

FIG. 8 is a thermocurve diagram of a differential thermal analysis for the alloy (31), wherein the glass transition temperature is of 273.0° C., and the crystallization temperature is of 296.8° C. The endotherm between the glass transition temperature (Tg) and the crystallization temperature (Tx) is of 8 J/g.

The amorphous aluminum-based alloys (30) to (33) are higher in amorphous phase forming ability and have a volume fraction of 100%. In addition, they have an endotherm as high as 5 J/g or more and thus, have a wider plastically workable region. This ensures that in producing members using the alloys (30) to (33) by utilizing a working process such as a hot extruding process, a hot forging process and the like, the workability thereof is satisfactory.

The improvement in endotherm can be achieved by using Ni and Co in combination, and an effect provided by the use of them in combination is also revealed to increase the crystallization temperature of the Al—Ni—Dy based alloys.

Fe has the effect of raising the crystallization temperature (Tx) of the above-described alloys to provide an improved heat resistance. As apparent from comparison of the alloy (32) with the alloy (33), the addition of Fe helped to raise the crystallization temperature (Tx) of the alloy (33) by 30° C. from that of the alloy (32).

IV. A fourth group of amorphous aluminum-based alloys

An amorphous aluminum-based alloy belonging to the fourth group has a composition comprising 75 atom %≦Al≦90 atom %,
3 atom %≦Ni+Co and/or Fe≦15 atom %,
1 atom %≦heavy rare earth element≦12 atom %, and light rare earth element≦8 atom %.

Here, at least one element selected from the group consisting of Dy, Er and Gd corresponds to the heavy rare earth element.

In addition, at least one element selected from the group consisting of La, Ce, Pr, Nd and Mm corresponds to the light rare earth element. The addition of such a light rare earth element ensures that the amorphous phase forming ability for the alloys can be further enhanced.

The amorphous aluminum-based alloys produced using Ni and Co in combination and using Dy as a heavy rare earth element include those having a composition comprising 80 atom %≦Al≦90 atom %,
3 atom %≦Ni+Co≦13 atom %,
1 atom %≦Dy≦12 atom %, and
light rare earth element≦6 atom %.

The use of such heavy and light rare earth elements in combination is an effective technique for enhancing the amorphous phase forming ability. Optimal examples of amounts of incorporation of chemical constituents in this case are as follows:

80 atom %≦Al≦90 atom %,
3 atom %≦Ni+Co and/or Fe≦13 atom %,
1 atom %≦heavy rare earth element≦10 atom %, and
1 atom %≦light rare earth element≦6 atom %.

Table IV illustrates the composition, structure, endotherm and crystallization temperature (Tx) of an amorphous aluminum-based alloy (34) belonging to the fourth group. In the "structure" column, a indicates that the alloy is of amorphous structure.

TABLE IV

| Alloy No. | Composition (atom %) | Structure | Endotherm (J/g) | Tx (°C.) |
|---|---|---|---|---|
| (34) | $Al_{84}Ni_8Dy_3Mm_3Co_2$ | a | 6 | 300.2 |

Figure 9:
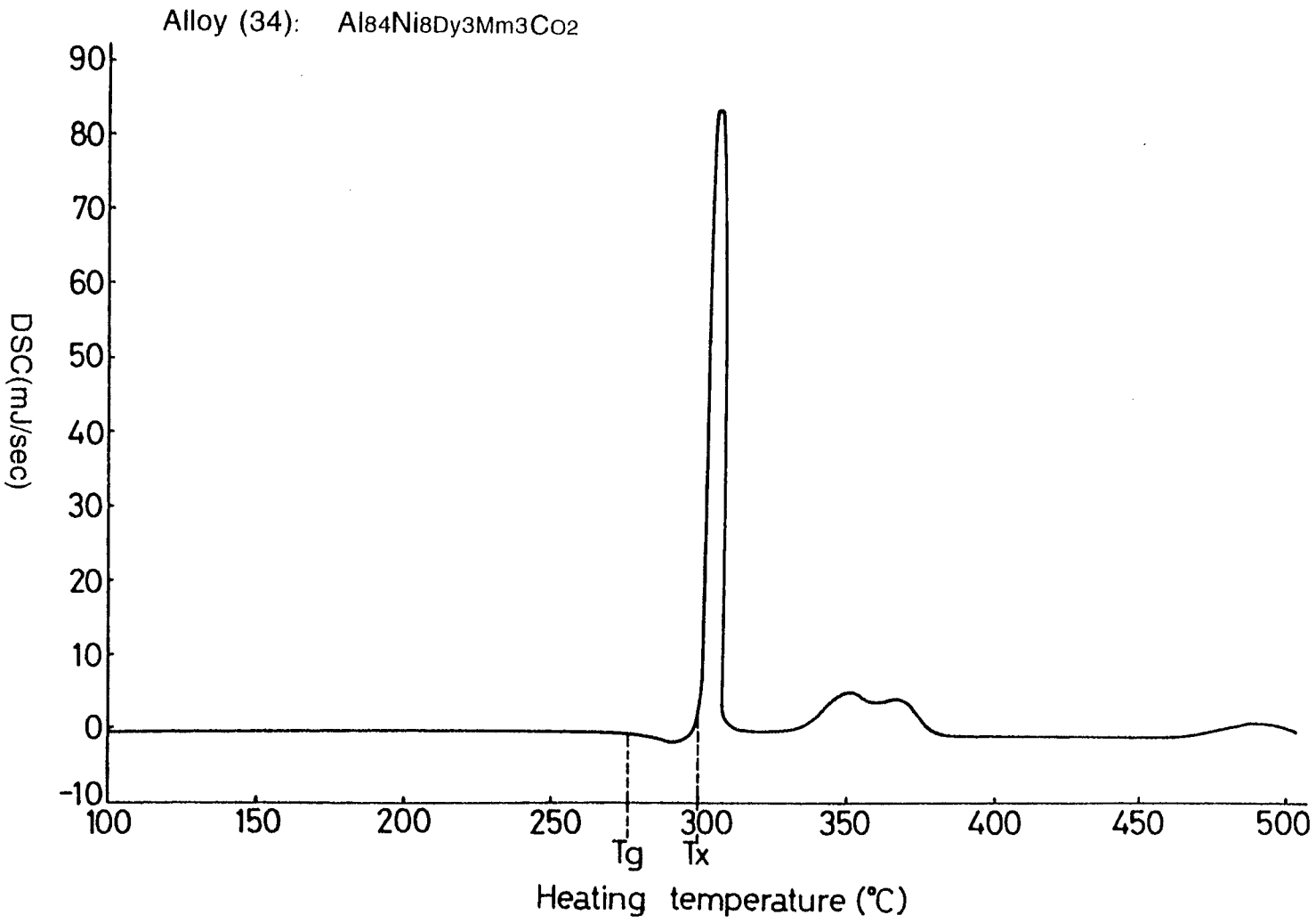

FIG. 9 is a thermocurve diagram of a differential thermal analysis for the alloy (34), wherein the glass transition temperature (Tg) is of 276.1° C., and the crystallization temperature is of 300.2° C. The endotherm between the glass transition temperature (Tg) and the crystallization temperature (Tx) is of 6 J/g.

The amorphous aluminum-based alloy (34) is higher in amorphous phase forming ability and has an amorphous phase volume fraction of an of 100%. In addition, it has a high endotherm of 6 J/g and thus, has a wider plastically workable region. This ensures that in producing a member using the alloy (34) by utilizing a working process such as a hot extruding process, a hot forging process and the like, the workability thereof is satisfactory.

The use of the heavy and light rare earth elements in combination has provided good results in Al—(Ni, Co, Fe)—(Dy, Er, Gd)—(La, Ce, Pr, Nd) based alloys and Al—(Ni, Co, Fe)—(Dy, Er, Gd)—Mm based alloys.

The other amorphous aluminum-based alloys in accordance with the present invention include those having the following compositions:

80 atom %≦Al≦90 atom %,
3 atom %≦Ni≦13 atom %,
0.5 atom %≦Fe≦3 atom %, and
3 atom %≦Dy≦12 atom %, typical of the alloys of this type being $Al_{84}Ni_9Fe_1Dy_6$;

80 atom %≦Al≦90 atom %,
3 atom %≦Ni≦13 atom %,
0.5 atom %≦Fe≦3 atom %,
1 atom %≦Dy≦12 atom %, and
light rare earth element≦6 atom %, the light rare earth element being at least one element selected from the group consisting of La, Ce, Pr, Nd and Mm, and typical of the alloys of this type being $Al_{84}Ni_9Fe_1Dy_3La_3$;

80 atom %≦Al≦90 atom %,
3 atom %≦Ni+Co≦13 atom %,
0.5 atom %≦Fe≦3 atom %,
1 atom %≦Dy≦12 atom %, and
light rare earth element≦6 atom %, the light rare earth element being at least one element selected from the group consisting of La, Ce, Pr, Nd and Mm, and the alloys of this type including $Al_{84}Ni_7Co_2Fe_1Dy_3La_3$.

Description will now be made of the production of a structural member using, by way of example, powder of the alloy (6) having a composition of $Al_{84}Ni_{10}Dy_6$ given in Table 1.

First, a green compact having a diameter of 58 mm and a length of 50 mm was prepared using the above-described powder, then placed into an aluminum (or copper) can having a wall thickness of 10 mm, and subjected to a hot extrusion at an extrusion ratio of 13, thereby providing a bar-like structural member.

Table V illustrates the physical properties of various structural members produced by the above process.

TABLE V

| green compact | | Structural member | | |
|---|---|---|---|---|
| Fo.tem. (°C.) | Den. of P.C. (%) | Ex.Tem. (°C.) | Den. (%) | Vf of Am.In. (%) |
| Room Tem. | 90 | 270 | 98 | ≧90 |
| 220 | 90 | 270 | 98 | ≧90 |
| 240 | 90 | 270 | 98 | ≧90 |
| 250 | 90 | 270 | cracking | 40 |
| 260 | 90 | 270 | failure to work | 15 |
| 280 | 90 | 270 | failure to work | 10 |
| Room Tem. | 70 | 270 | cracking | 40 |
| Room Tem. | 80 | 270 | 98 | ≧90 |
| 220 | 70 | 270 | cracking | 40 |
| 220 | 80 | 270 | 98 | ≧90 |
| 250 | 70 | 270 | failure to work | 20 |
| 250 | 80 | 270 | cracking | 30 |

Fo.tem. = Forming temperature
Den. of P.C. = Density of green compact
Ex.Tem. = Extruding temperature
Den. = Density
Vf of Am. In. = Vf of amorphous ingredients As apparent from Table V, if the formation of the green compact is conducted in a temperature range lower, by 40° C. or more, than 286.6° C., which is the crystallization temperature of the amorphous alloy powder having a composition of $Al_{84}Ni_{10}Dy_6$, so that the density of the green compact is to at least 80%, it is possible to provide a structural member with an improved density and to inhibit the reduction of the amorphous phase volume fraction (Vf) to the utmost.

Figure 10:
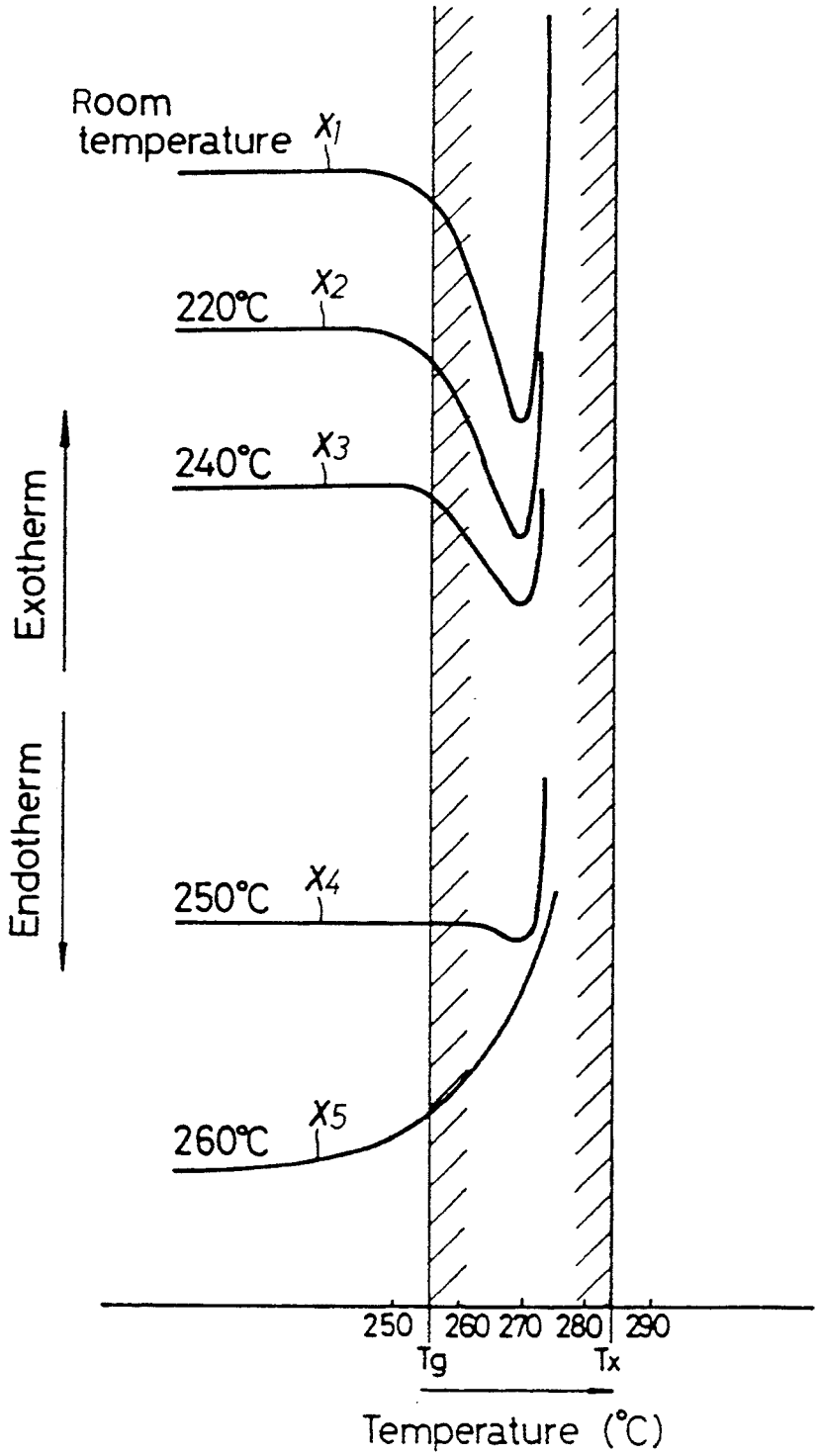
FIG. 10 is a thermocurve diagram of a differential thermal analysis for various green compacts.

FIG. 10 illustrates a portion of a thermocurve diagram of a differential thermal analysis for each of various green compacts prepared using the amorphous alloy powder ($Al_{84}Ni_{10}Dy_6$) which is in the vicinity of the glass transition temperature (Tg) and the crystallization temperature (Tx), wherein a line $x_1$ corresponds to the case where the forming temperature is room temperature, and lines $x_2$ to $x_5$ correspond to the cases where the forming temperature is of 220° C., 240° C., 250° C. and 260° C., respectively.

In each of the lines $x_1$ to $x_3$, a suddenly falling curve portion appears due to an endothermic phenomenon in a temperature range exceeding the glass transition temperature (Tg). This means that the temperature region for plastification of the green compact is wide, leading to a good hot-extrudability of each green compact.

In contrast, with the green compact indicated by the line $x_4$, the temperature region for plastification thereof is narrower, and with the green compact indicated by the line $x_5$, there is no temperature region for plastification, resulting in a deteriorated hot-extrudability of each green compact.

What is claimed is:

1. A high strength amorphous aluminum-based alloy comprising:

75 atom % (inclusive) to 90 atom % (inclusive) of Al;
3 atom % (inclusive) to 15 atom % (inclusive) of Ni;
1 atom % (inclusive) to 12 atom % (inclusive) of at least one element selected from a group consisting of Dy, Er and Gd; and
1 atom % (inclusive) to 8 atom % (inclusive) of at least one element selected from a group consisting of La, Ce, Pr, Nd and Mm (misch metal),
said alloy having an amorphous phase volume fraction (Vf) of at least 50% and an endotherm of 5 J/g or more between its glass transition temperature (Tg) and its crystallization temperature (Tx).

2. A high strength amorphous aluminum-based alloy comprising:

75 atom % (inclusive) to 90 atom % (inclusive) of Al;
3 atom % (inclusive) to 15 atom % (inclusive) of Ni and at least one element selected from Co and Fe;
1 atom % (inclusive) to 12 atom % (inclusive) of at least one element selected from a group consisting of Dy, Er and Gd; and
1 atom % (inclusive) to 8 atom % (inclusive) of at least one element selected from a group consisting of La, Ce, Pr, Nd and Mm (misch metal),
said alloy having an amorphous phase volume fraction (Vf) of at least 50% and an endotherm of 5 J/g or more between its glass transition temperature (Tg) and its crystallization temperature (Tx).

3. A high strength amorphous aluminum-based alloy comprising:

80 atom % (inclusive) to 90 atom % (inclusive) of Al;
3 atom % (inclusive) to 13 atom % (inclusive) of Ni;
1 atom % (inclusive) to 12 atom % (inclusive) of Dy; and
1 atom % (inclusive) to 6 atom % (inclusive) of at least one element selected from a group consisting of La, Ce, Pr, Nd and Mm (misch metal),
said alloy having an amorphous phase volume fraction (Vf) of at least 50% and an endotherm of 5 J/g or more between its glass transition temperature (Tg) and its crystallization temperature (Tx).

4. A high strength amorphous aluminum-based alloy comprising:

80 atom % (inclusive) to 90 atom % (inclusive) of Al;
3 atom % (inclusive) to 13 atom % (inclusive) of Ni and Co;
1 atom % (inclusive) to 12 atom % (inclusive) of Dy; and
1 atom % (inclusive) to 6 atom % (inclusive) of at least one element selected from a group consisting of La, Ce, Pr, Nd, and Mm (misch metal),
said alloy having an amorphous phase volume fraction (Vf) of at least 50% and an endotherm of 5 J/g or more between its glass transition temperature (Tg) and its crystallization temperature (Tx).

5. A high strength amorphous aluminum-based alloy comprising:

80 atom % (inclusive) to 90 atom % (inclusive) of Al;
3 atom % (inclusive) to 13 atom % (inclusive) of Ni;
0.5 atom % (inclusive) to 3 atom % (inclusive) of Fe;
1 atom % (inclusive) to 12 atom % (inclusive) of Dy; and
1 atom % (inclusive) to 6 atom % (inclusive) of at least one element selected from a group consisting of La, Ce, Pr, Nd and Mm (misch metal),
said alloy having an amorphous phase volume fraction (Vf) of at least 50% and an endotherm of 5 J/g or more between its glass transition temperature (Tg) and its crystallization temperature (Tx).

6. A high strength amorphous aluminum-based alloy comprising:

80 atom % (inclusive) to 90 atom % (inclusive) of Al;
3 atom % (inclusive) to 13 atom % (inclusive) of Ni and Co;
0.5 atom % (inclusive) to 3 atom % (inclusive) of Fe;
1 atom % (inclusive) to 12 atom % (inclusive) of Dy; and
1 atom % (inclusive) to 6 atom % (inclusive) of at least one element selected from a group consisting of La, Ce, Pr, Nd and Mm (misch metal),
said alloy having an amorphous phase volume fraction (Vf) of at least 50% and an endotherm of 5 J/g or more between its glass transition temperature (Tg) and its crystallization temperature (Tx).

7. A high strength amorphous aluminum-based alloy comprising:

80 atom % (inclusive) to 90 atom % (inclusive) of Al;
3 atom % (inclusive) to 13 atom % (inclusive) of Ni;
1 atom % (inclusive) to 10 atom % (inclusive) of at least one element selected from a group consisting of Dy, Er and Gd; and
1 atom % (inclusive) to 10 atom % (inclusive) of at least one element selected from a group consisting of La, Ce, Pr, Nd and Mm (misch metal),
said alloy having an amorphous phase volume fraction (Vf) of at least 50% and an endotherm of 5 J/g or more between its glass transition temperature (Tg) and its crystallization temperature (Tx).

8. A high strength amorphous aluminum-based alloy comprising:

80 atom % (inclusive) to 90 atom % (inclusive) of Al;
3 atom % (inclusive) to 13 atom % (inclusive) of Ni and at least one element selected from Co and Fe;
1 atom % (inclusive) to 10 atom % (inclusive) of at least one element selected from a group consisting of Dy, Er and Gd; and
1 atom % (inclusive) to 6 atom % (inclusive) of at least one element selected from a group consisting of La, Ce, Pr, Nd and Mm (misch metal), said alloy having an amorphous phase volume fraction (Vf) of at least 50% and an endotherm of 5 J/g or more between its glass transition temperature (Tg) and its crystallization temperature (Tx).

9. A high strength amorphous aluminum-based alloy comprising:

75 atom % (inclusive) to 90 atom % (inclusive) of Al;

3 atom % (inclusive) to 15 atom % (inclusive) of Ni; and 3 atom % (inclusive) to 12 atom % (inclusive) of at least one element selected from a group consisting of Dy, Er and Gd, said alloy having an amorphous phase volume fraction (Vf) of at least 50% and an endotherm of 5 J/g or more between its glass transition temperature (Tg) and its crystallization temperature (Tx).

10. A high strength amorphous aluminum-based alloy comprising:

75 atom % (inclusive) to 90 atom % (inclusive) of Al;

3 atom % (inclusive) to 15 atom % (inclusive) of Ni plus at least one element selected from Co and Fe; and 3 atom % (inclusive) to 12 atom % (inclusive) of at least one element selected from a group consisting of Dy, Er and Gd, said alloy having an amorphous phase volume fraction (Vf) of at least 50% and an endotherm of 5 J/g or more between its glass transition temperature (Tg) and its crystallization temperature (Tx).

11. A high strength amorphous aluminum-based alloy comprising:

80 atom % (inclusive) to 90 atom % (inclusive) of Al;

3 atom % (inclusive) to 13 atom % (inclusive) of Ni; and 3 atom % (inclusive) to 12 atom % (inclusive) of Dy, said alloy having an amorphous phase volume fraction (Vf) of at least 50% and an endotherm of 5 J/g or more between its glass transition temperature (Tg) and its crystallization temperature (Tx).

12. A high strength amorphous aluminum-based alloy comprising:

80 atom % (inclusive) to 90 atom % (inclusive) of Al;

3 atom % (inclusive) to 13 atom % (inclusive) of Ni and Co; and 3 atom % (inclusive) to 12 atom % (inclusive) of Dy, said alloy having an amorphous phase volume fraction (Vf) of at least 50% and an endotherm or 5 J/g or more between its glass transition temperature (Tg) and its crystallization temperature (Tx).

13. A high strength amorphous aluminum-based alloy comprising:

80 atom % (inclusive) to 90 atom % (inclusive) of Al;

3 atom % (inclusive) to 13 atom % (inclusive) of Ni;

0.5 atom % (inclusive) to 3 atom % (inclusive) of Fe; and 3 atom % (inclusive) to 12 atom % (inclusive) of Dy, said alloy having an amorphous phase volume fraction (Vf) of at least 50% and an endotherm of 5 J/g or more between its glass transition temperature (Tg) and its crystallization temperature (Tx).

14. A high strength amorphous aluminum-based alloy comprising:

80 atom % (inclusive) to 90 atom % (inclusive) of Al;

3 atom % (inclusive) to 13 atom % (inclusive) of Ni and Co;

0.5 atom % (inclusive) to 3 atom % (inclusive) of Fe; and 3 atom % (inclusive) to 12 atom % (inclusive) of Dy, said alloy having an amorphous phase volume fraction (Vf) of at least 50% and an endotherm of 5 J/g or more between its glass transition temperature (Tg) and its crystallization temperature (Tx).

* * * * *